US006394053B2

(12) United States Patent
Shin

(10) Patent No.: US 6,394,053 B2
(45) Date of Patent: May 28, 2002

(54) VALVE TRAIN FOR HIGH SPEED DIRECT INJECTION DIESEL ENGINE

(75) Inventor: Buom-Sik Shin, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/753,224

(22) Filed: Dec. 28, 2000

(30) Foreign Application Priority Data

Dec. 28, 1999 (KR) ..... 99-63693

(51) Int. Cl.[7] ..... F01L 1/18

(52) U.S. Cl. ..... 123/90.45; 123/90.16; 123/90.17; 123/308; 123/315; 123/432

(58) Field of Search ..... 123/90.15, 90.16, 123/90.17, 90.27, 90.39, 90.43, 90.41, 90.44, 90.45, 90.46, 308, 315, 432

(56) References Cited

U.S. PATENT DOCUMENTS 5,253,620 A * 10/1993 Dohn et al. ..... 123/90.16

5,676,107 A * 10/1997 Yuzuriha et al. ..... 123/302

* cited by examiner

*Primary Examiner*—Thomas Denion
*Assistant Examiner*—Jaime Corrigan
(74) *Attorney, Agent, or Firm*—Christie, Parker & Hale, LLP

(57) ABSTRACT

A valve train for a small size diesel engine includes a pair of camshafts rotatively supported by and passing over a top of a cylinder head, one pair of intake and exhaust cams on each camshaft for each cylinder, two intake ports and two exhaust ports formed on the cylinder head over and around a bore center of each cylinder for communicating with the cylinder bore, two intake valves and two exhaust valves installed into the corresponding ports for selectively opening and closing the ports, rocker arms of which one end of each is connected to upper ends of the corresponding valves, and lash adjusters connected to other ends of the corresponding rocker arms for adjusting lash between the rocker arms and the cams, wherein the intake and exhaust ports are arranged in an alternative zigzag fashion.

5 Claims, 6 Drawing Sheets

VALVE TRAIN FOR HIGH SPEED DIRECT INJECTION DIESEL ENGINE

BACKGROUND OF THE INVENTION (a) Field of the Invention

The present invention relates to a valve train for a diesel engine, and in particulars to a valve train arranged together with a dual overhead camshaft (DOHC) type cylinder head structure capable of being adopted by an engine having small cylinder bores.

(b) Description of the Related Art

Recently, to enhance energy efficiency and reduce exhaust gas emissions, direct injection-type high performance diesel engines have been equipped in vehicles. Furthermore, research and development on small passenger cars equipped with direct injection engines having low engine displacement, below 1000 cc, is active all around the world in order to comply with emission regulations and energy savings. To achieve these goals, various high technologies such as common rail fuel distribution, turbo chargers, and intercooler systems have been adopted by small passenger cars. FIG. 6 shows a part of a cylinder head 112 of a single over head camshaft (SOHC) engine having small cylinder bores, which is formed having intake and exhaust valves 114 and 116, a skew-installed fuel injector 118, and a glow plug 120.

As explained above, the SOHC engine of a 2-valve per cylinder valve train is disadvantageous relative to the DOHC engine of a 4-valve per cylinder valve train in the view of air intake, symmetrical swirl, high combustion rate, and so on.

Although the DOHC type cylinder head can be a solution to these problems, it is difficult to install the DOHC type valve train on an engine with a small cylinder bore.

SUMMARY OF THE INVENTION

The present invention has been made in an effort to solve the above problems of the prior art.

It is an object of the present invention to provide a 4-valve per cylinder valve train arranged with the DOHC type cylinder head capable of mounting on a DI diesel engine having small cylinder bores for enhancing fuel mileage, engine performance, and emission reduction.

To achieve the above object, a valve train for a small size diesel engine according to the present invention comprises a pair of camshafts rotatively supported by and passing over the top of a cylinder head, one pair of intake and exhaust cams on each camshaft for each cylinder, two intake ports and two exhaust ports formed on the cylinder head over and around a bore center of each cylinder for communicating with the cylinder bore, two intake valves and two exhaust valves installed into the corresponding ports for selectively opening and closing the ports, rocker arms of which one end of each is connected to upper ends of the corresponding valves, and lash adjusters connected to other ends of the corresponding rocker arms for adjusting lash between the rocker arms and the cams, wherein the intake and exhaust ports are arranged in an alternative zigzag fashion.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described hereinafter with reference to the accompanying drawings.

Figure 1:
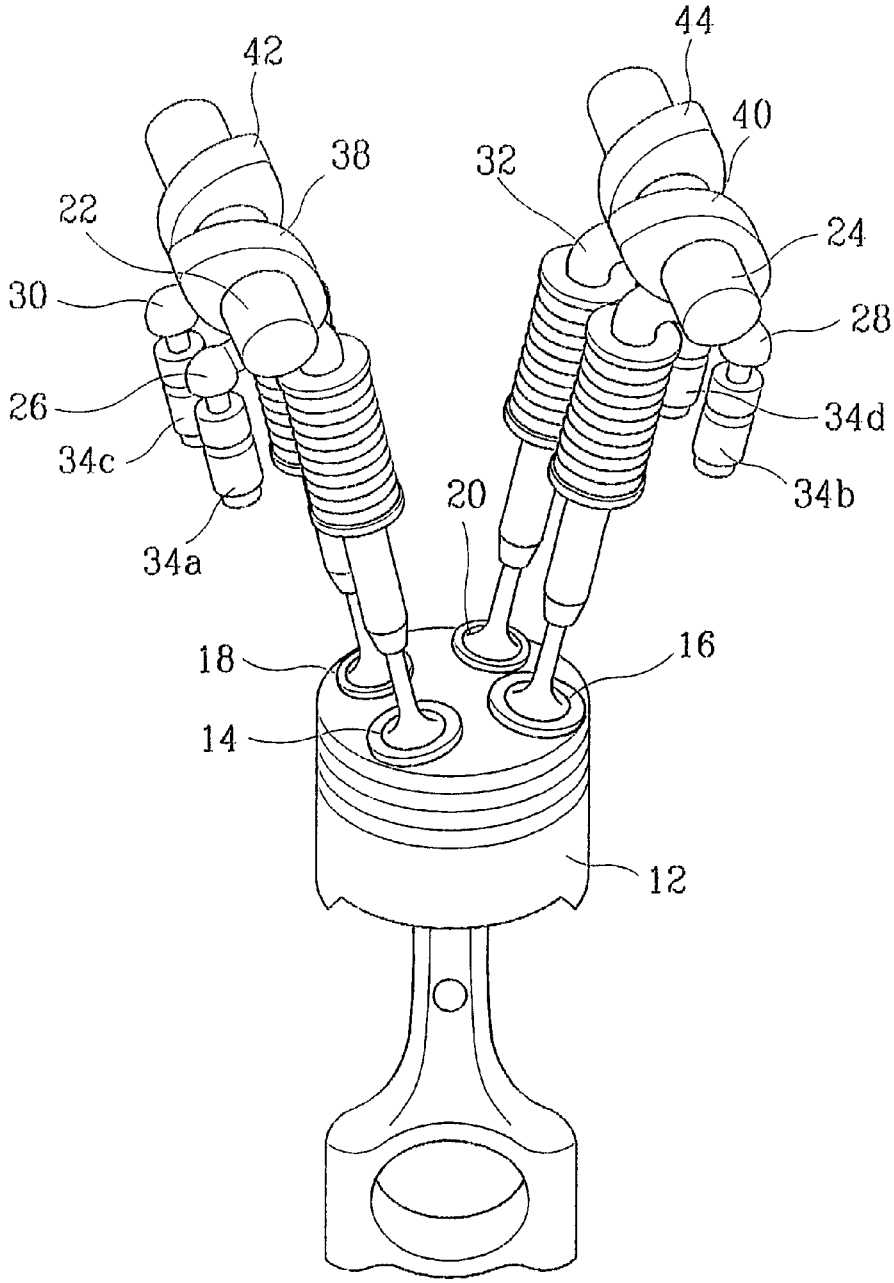
FIG. 1 is a perspective view of a valve train according to a preferred embodiment of the present invention.

Referring to FIG. 1, the valve train comprises a pair of intake valves 14 and 16 and a pair of exhaust valves 18 and 20 supported by a cylinder head (not shown), a pair of camshafts 22 and 24 having cams 38, 40, 42, and 44 for selectively actuating the valves 14, 16, 18, and 20, rocker arms 26, 28, 30, and 32 respectively interposed between the cams 38, 40, 42, and 44 and one end of the valves 14, 16, 18 and 20, and lash adjusters 34*a*, 34*b*, 34*c*, and 34*d* for adjusting lash amount between the rocker arms 26, 28, 30, and 32 and the corresponding cams 38, 40, 42, and 44.

Figure 2:
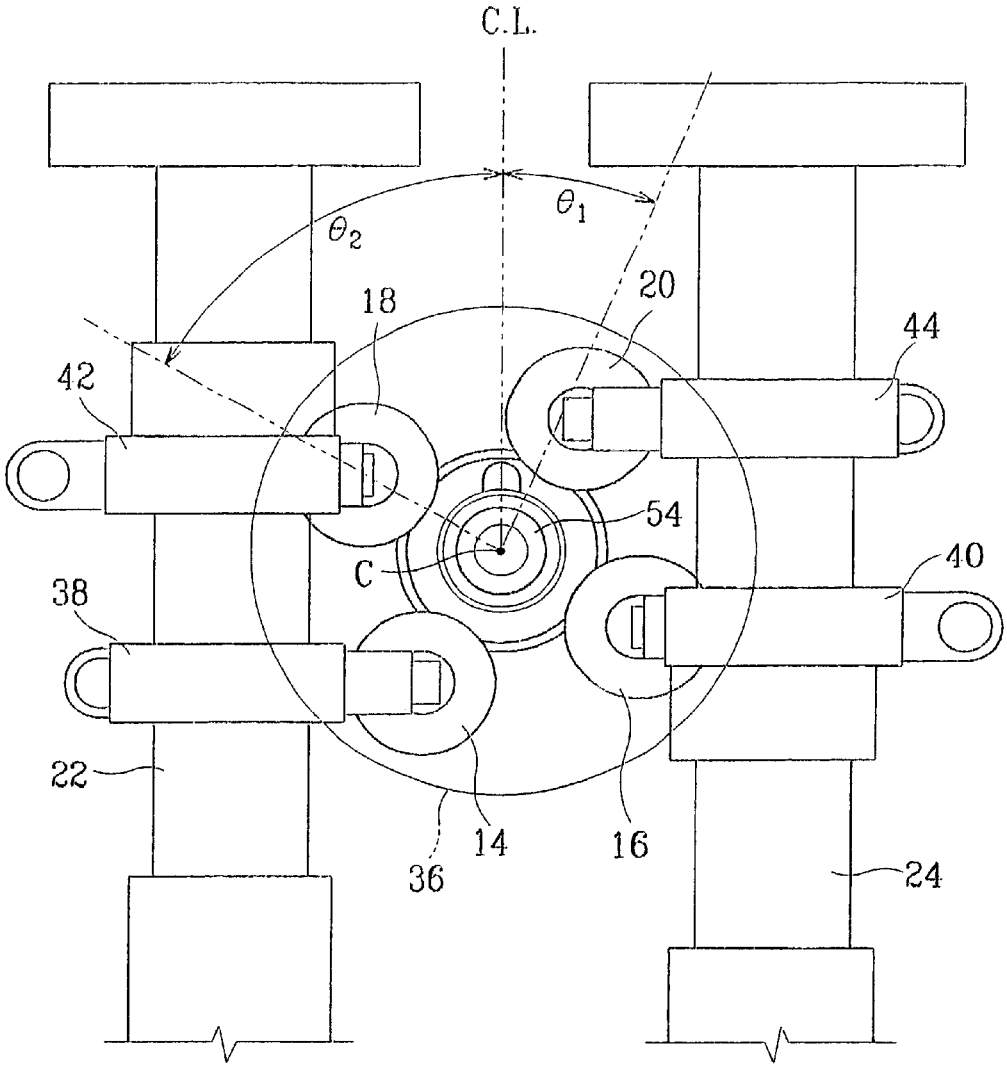
FIG. 2 is a top plane view of the valve train of FIG. 1.

As shown in FIG. 2, valve ports for receiving the valves are formed in a twisted configuration so as to be alternately positioned in a longitudinal direction of the camshafts 22 and 24.

Also the valve train is-positioned over a combustion chamber 36 such that the first camshaft 22 and the second camshaft 24 are passing over the cylinder head in parallel. The first camshaft 22 is provided with the first intake cam 38 and the first exhaust cam 42 and the second camshaft 24 is provided with the second intake cam 40 and the second exhaust cam 44 such that the cams 38, 40, 42, and 44 are alternately positioned to operate corresponding valves. That is, the first intake cam 38 and the second exhaust cam 42 of the first camshaft 22 are respectively positioned to operate the first intake valve 14 and the first exhaust valve 18, and the second intake cam 40 and the second exhaust cam 44 of the second camshaft 24 are respectively positioned to operate the second intake valve 16 and the second exhaust valve 20.

The first intake valve 14 and the second exhaust valve 20 are positioned close to a center line C.L. drawn in parallel with the camshafts 22 and 24 and the second intake valve 16 and the first exhaust valve 18 are positioned relatively far from the center line C.L. such that the first intake valve 14 and the second exhaust valve 20 are positioned at an angle $\theta_1$ from the center line C.L. on the axis of a bore center C of the cylinder and the second intake valve 18 and the first exhaust valve 16 are positioned at an angle $\theta_2$ from the center line C.L. on the axis of a bore center C. It is preferred that the angles $\theta_1$ and $\theta_2$ are set at 16° and 74°.

Figure 3:
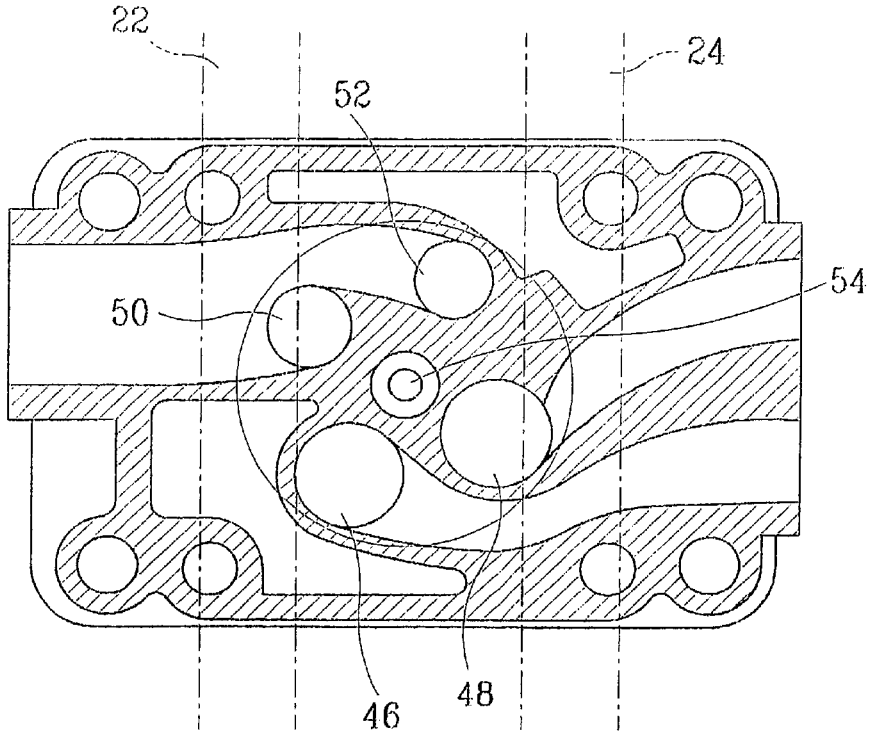
FIG. 3 is a parallel sectional view of a cylinder head according to the preferred embodiment of the present invention.

FIG. 3 is a sectional view of the cylinder head where the valve train is installed. The cylinder head is provided with a first intake port 46 and a first exhaust port 50 below the first camshaft 22 and a second intake port 48 and a second exhaust port 52 below the second camshaft 24 such that the first intake and exhaust valves 14 and 18 are respectively installed into the first intake port 46 and the first exhaust port

50 and the second intake and exhaust valves 16 and 20 are respectively installed into the second intake port 48 and the second exhaust port 52. At the center of the cylinder head, a fuel injector 54 is mounted.

The operation of the engine equipped with the above structured valve train will be described with reference to FIG. 4 and FIG. 5 hereinafter.

Figure 4:
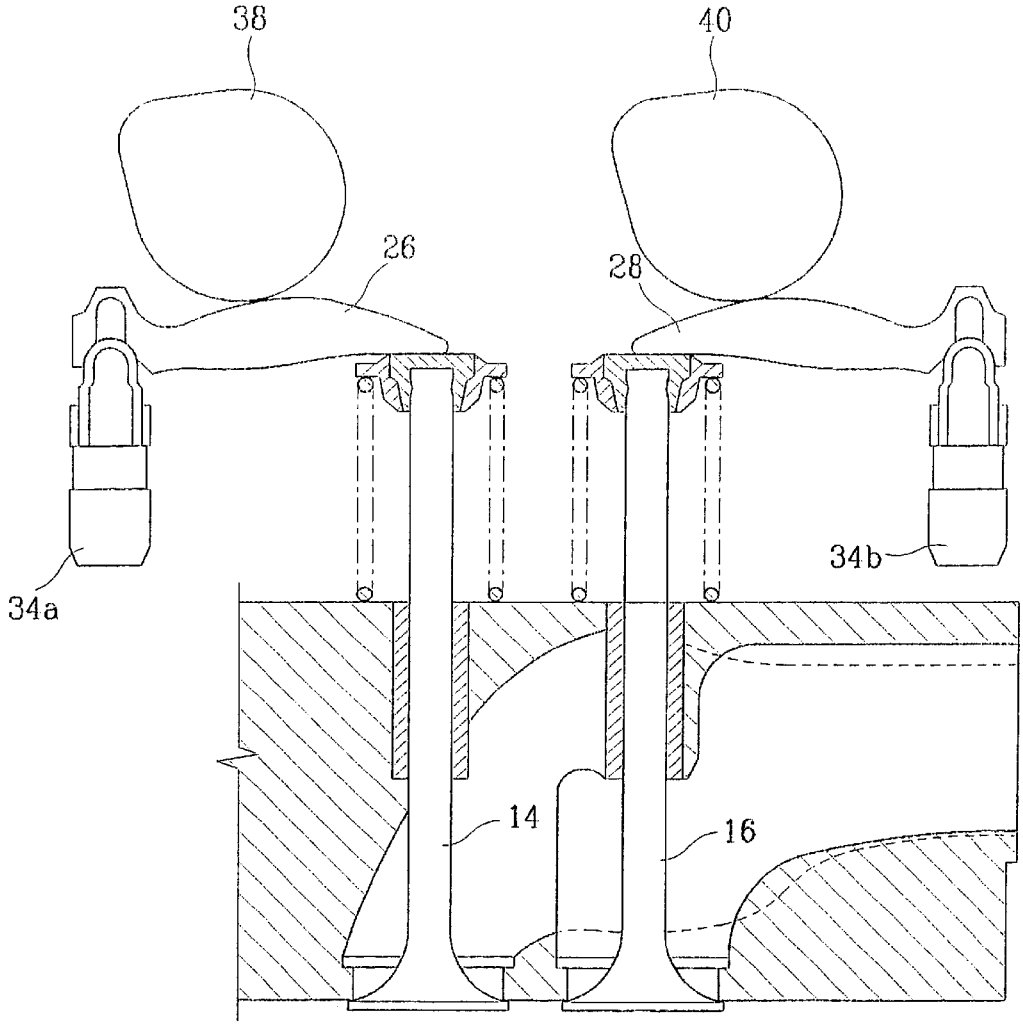
FIG. 4 is a side sectional view showing an intake part of the cylinder head with the valve train according to the preferred embodiment of the present invention.
Figure 5:
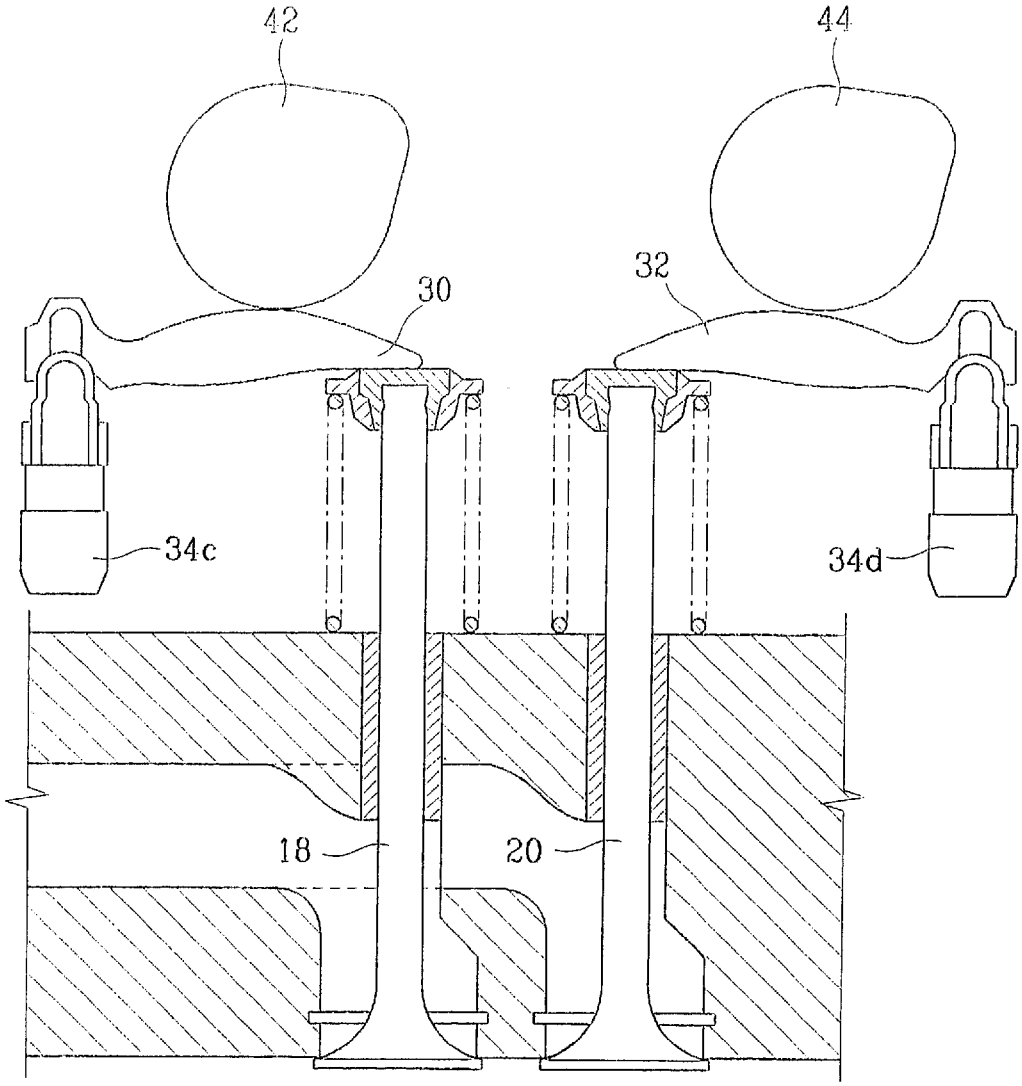
FIG. 5 is a side sectional view showing an exhaust part of the cylinder head with the valve train according to the preferred embodiment of the present invention.
Figure 6:
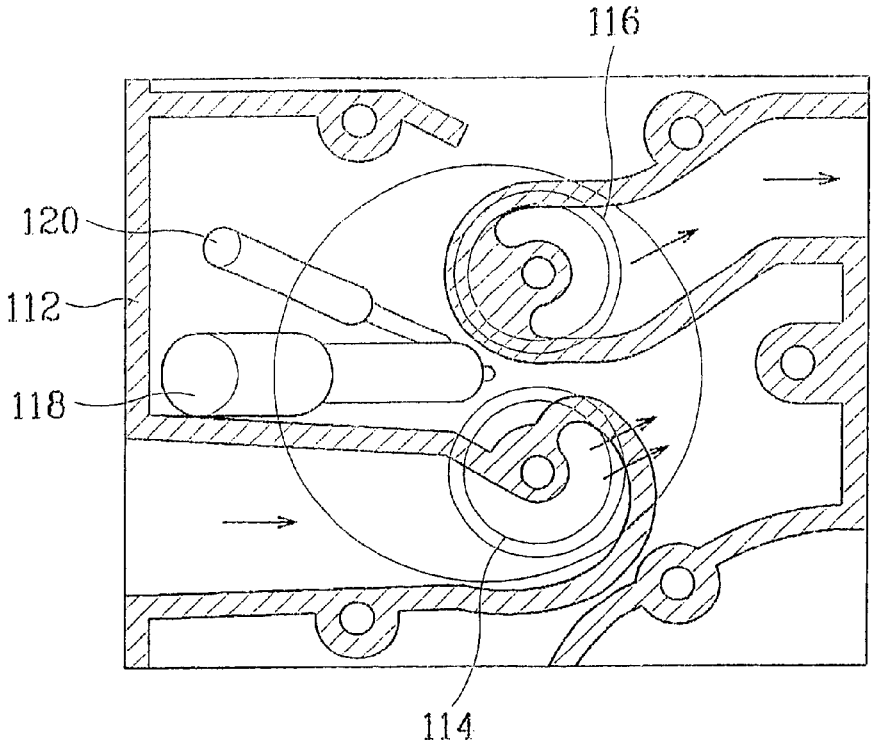
FIG. 6 is a parallel sectional view of a conventional cylinder head.

FIG. 4 shows the intake part of the cylinder head with the valve train. Upper ends of the first and second intake valves 14 and 16 are respectively connected to one end of the first and second intake rocker arms 26 and 28, and upper ends of the first and the second exhaust valves are respectively connected to one end of the first and second exhaust rocker arms 30 and 32. The rocker arms 26, 28, 30, and 32 are respectively connected to the lash adjusters 34*a*, 34*b*, 34*c*, and 34*d* at their other ends. Also, the intake rocker arms 26 and 28 respectively contact the intake cams 38 and 40 and the exhaust rocker arms 42 and 44 respectively contact the exhaust cams 30 and 32 such that the intake and exhaust valves 14, 16, 18, and 20 are operated in a timely fashion by the cams 38, 40, 42, 44 according to rotations of the first and second camshafts 22 and 24. Each valve is returned by elastic force of a return spring installed between a spring seat formed on an upper end portion of the valve and the cylinder head.

While the engine operates, the camshafts 22 and 24 interoperably rotate with the crankshaft (not shown) such that the intake and exhaust cams on the camshafts push the corresponding rocker arms which push the corresponding valves with a predetermined timing. As a result the valves are selectively opened and closed for supplying air and emitting exhaust gas.

As described above, in the valve train arranged with the cylinder head of the present invention, the valve ports are positioned in a twisted configuration around the cylinder bore, which reduces the installment space of the valve train, such that it is possible to implement a DOHC type 4-valve per cylinder valve train structure for a small cylinder bore engine. As a result of the implementation of a DOHC system in a small cylinder bore engine, many advantages in the view of fuel mileage, engine performance, and emission reduction can be obtained in small passenger cars.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A valve train for a small size diesel engine comprising:

a pair of camshafts rotatively supported by and passing over a top of a cylinder head;

one pair of intake and exhaust cams on each camshaft for each cylinder;

two intake ports and two exhaust ports formed on the cylinder head over and around a bore center of each cylinder for communicating with the cylinder bore;

two intake valves and two exhaust valves installed into the corresponding ports for selectively opening and closing the ports;

rocker arms of which one end of each is connected to upper ends of the corresponding valves; and lash adjusters connected to other ends of the corresponding rocker arms for adjusting lash between the rocker arms and the cams;

wherein the intake and exhaust ports are arranged in an alternative zigzag fashion.

2. A valve train of claim 1 wherein each pair of intake and exhaust cams mounted on respective camshafts in the alternately zigzag fashion of the port arrangement.

3. A valve train of claim 1 wherein one of the intake valves and the exhaust valve diagonally positioned with the intake valve are arranged close to a centerline passing a bore center of the cylinder in parallel with the two camshafts and the other intake and exhaust valves are arranged close to the camshafts.

4. A valve train of claim 3 wherein centers of the intake and exhaust valve close to the center line are at angle of 16° relative to the centerline parallel to the camshafts.

5. A valve train of claim 3 wherein centers of the intake and exhaust valves close to the camshafts are at angle of 74° relative to the centerline.

* * * * *